US008587453B2

(12) United States Patent
Cripps

(10) Patent No.: US 8,587,453 B2
(45) Date of Patent: Nov. 19, 2013

(54) PORTABLE TRAFFIC SIGNALING SYSTEM

(76) Inventor: Jeffrey L. Cripps, Waterford, MI (US)

( * ) Notice: Subject to any disclaimer, the term of this patent is extended or adjusted under 35 U.S.C. 154(b) by 252 days.

(21) Appl. No.: 13/085,656

(22) Filed: Apr. 13, 2011

(65) Prior Publication Data

US 2012/0262304 A1 Oct. 18, 2012

(51) Int. Cl.
*G08G 1/095* (2006.01)

(52) U.S. Cl.
USPC ..... 340/908; 340/908.1; 340/910; 701/532

(58) Field of Classification Search
USPC ..... 340/908, 908.1, 910; 701/532
See application file for complete search history.

(56) References Cited

U.S. PATENT DOCUMENTS 5,400,019 A * 3/1995 Riscoe, Jr. ..... 340/908
5,986,576 A * 11/1999 Armstrong ..... 340/908
6,118,388 A * 9/2000 Morrison ..... 340/908
2005/0270176 A1* 12/2005 Richardson et al. ..... 340/908
2007/0126599 A1* 6/2007 Gembala et al. ..... 340/908
2007/0290887 A1* 12/2007 Pleasanton ..... 340/908
2008/0129543 A1* 6/2008 Lee ..... 340/908
2008/0198038 A1* 8/2008 Yingst et al. ..... 340/908
2009/0058680 A1* 3/2009 Benn ..... 340/908.1
2009/0070031 A1* 3/2009 Ginsberg ..... 701/208
2011/0037619 A1* 2/2011 Ginsberg et al. ..... 340/910

* cited by examiner

*Primary Examiner* — Daniel Wu
*Assistant Examiner* — Israel Daramola
(74) *Attorney, Agent, or Firm* — Garlick & Markison; Bruce E. Stuckman

(57) ABSTRACT

A portable traffic signaling system includes a plurality of portable traffic signals, each of the portable traffic signals having a plurality of traffic lights and a stand having legs that fold for transport and unfold for deployment. A short range wireless traffic signal transceiver that communicates bidirectionally via a short range wireless communication link. A traffic signal processing module controls the operation of the plurality of traffic lights to at least: a stop condition, and a go condition based on control data, such as control data received from a remote control device via the short range wireless communication link.

10 Claims, 7 Drawing Sheets

100 or 102

100 or 102

PORTABLE TRAFFIC SIGNALING SYSTEM

CROSS REFERENCE TO RELATED APPLICATIONS

Not applicable

BACKGROUND OF THE INVENTION

1. Technical Field of the Invention

The present invention relates to traffic signaling systems such as traffic lights.

2. Description of Related Art

As is known, conventional traffic signals provide the basis of controlling the majority of traffic. Fixed signals are installed at important intersections to control traffic flow. In some systems, the traffic signals are controlled based on time of day or to the presence and absence of traffic to enable or disable traffic flow along the roads that intersect to avoid collisions and otherwise in an attempt to maximize traffic throughput.

When a road is under construction, it is not uncommon for a road that normally permits two-way traffic flow to be limited to a single lane of traffic along the segment where the construction occurs. To permit two-way traffic flow, workers employing handheld stop and go signs, flags or other manual signals alternate the traffic flow from one direction to another to permit two way traffic flow along the one lane segment.

The disadvantages of conventional approaches will be evident to one skilled in the art when presented the disclosure that follows.

DETAILED DESCRIPTION OF THE INVENTION

Figure 1:
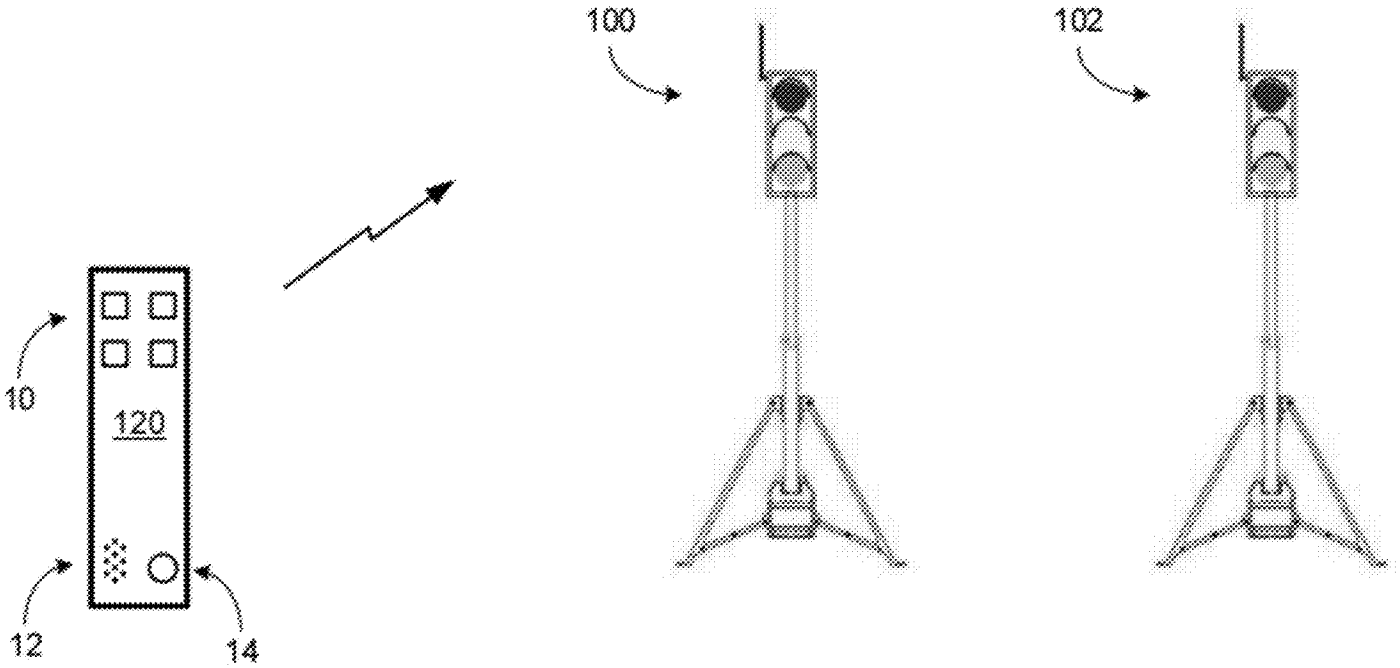
FIG. 1 presents a pictorial representation of a portable traffic signaling system in accordance with an embodiment of the present invention.

FIG. 1 presents a pictorial representation of a portable traffic signaling system in accordance with an embodiment of the present invention. In particular, a portable traffic signaling system is shown that includes two or more portable traffic signals, such as portable traffic signals 100 and 102. In addition, a remote control device 120 is shown that includes a user interface that includes push buttons 10, a light emitter 14 such as a light emitting diode (LED) or other emitter, and sound emitter 12 such as a beeper, buzzer, speaker or other audio device. While particular user interface devices are shown, the wireless device can similarly include other devices such as a touch screen or other display screen, a thumb wheel, trackball, and/or other input or output devices.

The portable traffic signals 100 and 102 each have corresponding traffic lights, such as a red, yellow and green light, directional indicators or other traffic lights. The portable traffic signals 100 and 102 can placed to assist in the control of traffic in area in need of temporary traffic signaling such as a construction zone, an area where conventional traffic signals are nonoperational, or in an area that is experiencing above normal traffic flows such as at a sporting event, concert of other event venue.

The remote control device 120 and the portable traffic signals 100 and 102 each include a short-range wireless transceiver that bidirectionally communicates a wireless infrared or RF signaling over one or more short-range wireless communication channels. The short-range wireless transceiver operates in conjunction with a communication standard such as 802.11, Bluetooth, ZigBee, ultra-wideband, Wimax, infrared data association (IrDA), other standard short or medium range communication protocol, or other protocol.

Control signaling among the remote control device 120 and the portable traffic signals 100 and 102 can be used to coordinate the control of the traffic lights of the portable traffic signals 100 and 102. In this fashion, for example, traffic in one direction can be stopped while traffic in another direction can be allowed to proceed to facilitate safe and efficient traffic flow.

Further details regarding the structure and operation of remote control device 120 and portable traffic signals 100 and 102 including several optional functions and features are presented in conjunction with FIGS. 2-9 that follow.

Figure 2:
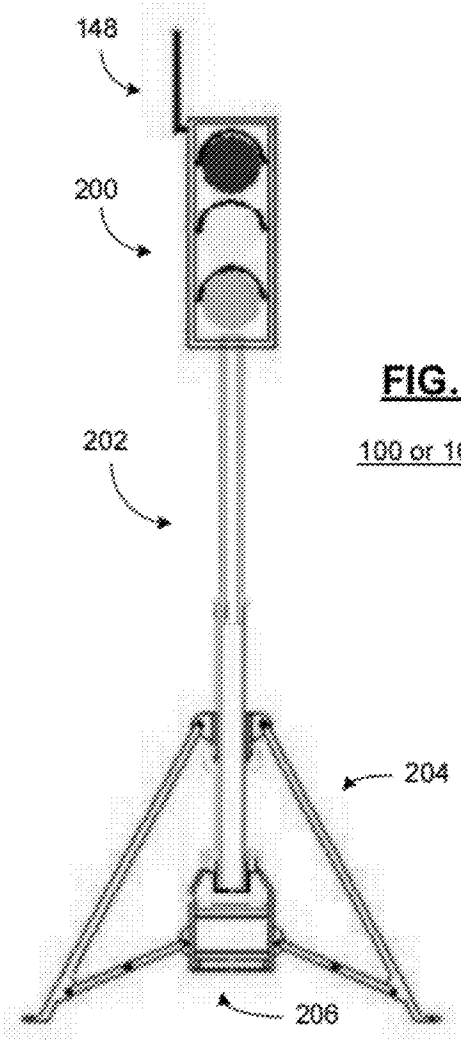
FIG. 2 presents a front view of a portable traffic signal 100 or 102 in accordance with an embodiment of the present invention.

FIG. 2 presents a front view of a portable traffic signal 100 or 102 in accordance with an embodiment of the present invention. In particular, portable traffic signal 100 or 102 includes a lighting head 200 having a plurality of traffic lights. The lighting head 200 is mounted on a stand having a telescoping pole 202 that can be extended for operation and collapsed for transport or storage; and legs, such as tripod 204, that fold for transport and unfold for deployment. The stand further includes housing 206 that houses one or more weights for providing gravitational stability for the unit. It should be noted the communication and control elements of the portable traffic signal 100 or 102 could be located in either the lighting head 200 or the housing 206. As discussed in conjunction with FIG. 1, the communication and control elements include a short-range wireless transceiver that is coupled to RF antenna 148 and/or to an infrared emitter/receptor pair not specifically shown.

While not specifically shown, the portable traffic signals 100 and 102 can include a traffic sensor, such as a metal detector, proximity detector, electric eye, or video imaging system that generates sensor data that indicates either the presence of one or more cars in queue waiting to pass. In another example the sensor data includes passage data that indicates passage of a vehicle past the portable traffic signals, for example to allow the system to count the number of vehicles that have passed during a particular cycle. In a further example, the portable traffic signals 100 and 102 can include an alarm that is activated via alarm data generated the passage data indicates the passage of the vehicle past the portable traffic signals when the portable traffic signals is in the stop condition (red light).

Figure 3:
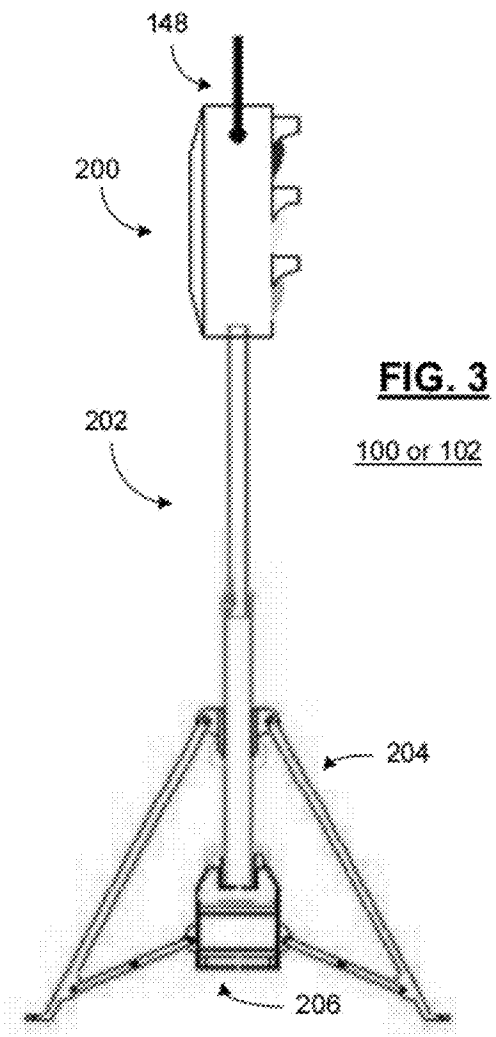
FIG. 3 presents a side view of a portable traffic signal 100 or 102 in accordance with an embodiment of the present invention.

FIG. 3 presents a side view of a portable traffic signal 100 or 102 in accordance with an embodiment of the present invention. In particular, this view of portable traffic signal 100 or 102 includes common elements described in conjunction with FIG. 2.

Figure 4:
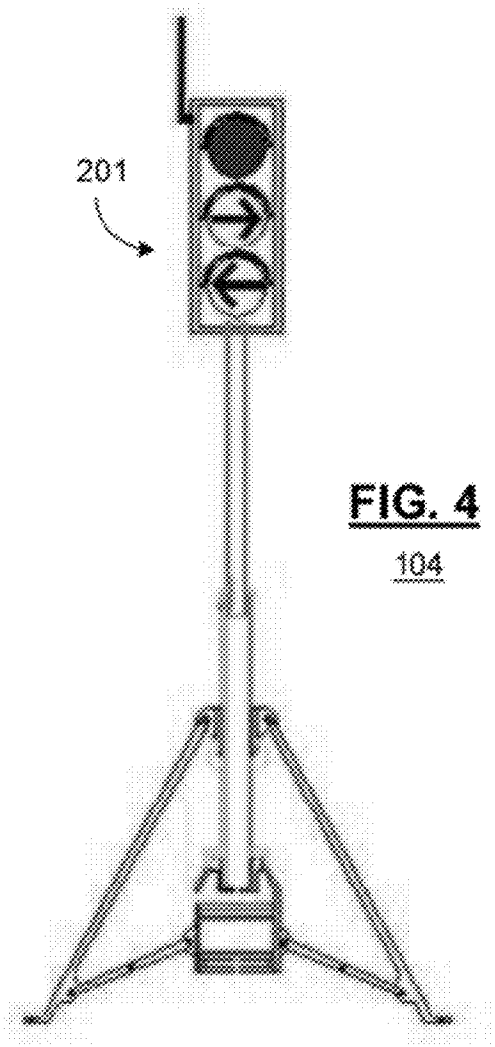
FIG. 4 presents a front view of a portable traffic signal 104 in accordance with an embodiment of the present invention.

FIG. 4 presents a front view of a portable traffic signal 104 in accordance with an embodiment of the present invention. In this configuration, the traffic lights of lighting head 201 include two directional indicators—corresponding to right and left turns. This alternative design can be used, for example, for traffic control on a side street, driveway or other site where directional control is required. Traffic entering a construction zone can be controlled to turn right or left at specific times.

Figure 5:
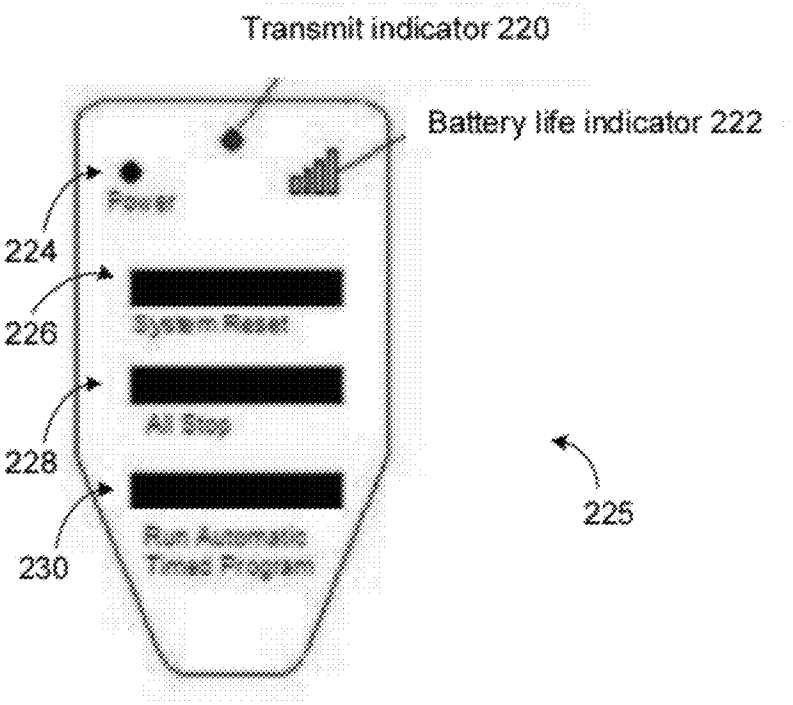
FIG. 5 presents a pictorial representation of a remote control device 225 in accordance with an embodiment of the present invention.

FIG. 5 presents a pictorial representation of a remote control device 225 in accordance with an embodiment of the present invention. In particular, Remote control device 225 is a particular embodiment of remote control device 120. The remote control device 225 includes a short-range wireless transceiver that bidirectionally communicates a wireless infrared or RF signaling over one or more short-range wireless communication channels with portable traffic signals 100, 102 and 104. The short-range wireless transceiver operates in conjunction with a communication standard such as 802.11, Bluetooth, ZigBee, ultra-wideband, Wimax, infrared data association (IrDA), other standard short or medium range communication protocol, or other protocol. Control data sent from the remote control device 225 and the portable traffic signals 100, 102 and 104 can be used to coordinate the control of the traffic lights of the portable traffic signals 100, 102 and 104. In this fashion, traffic in one direction can be stopped while traffic in another direction can be allowed to proceed to facilitate safe and efficient traffic flow.

In the embodiment shown, remote control device 225 includes a power indicator 224, such as a light emitting diode (LED) or other indicator that indicates when the device is on and operational. Remote control device 225 also includes a transmit indicator 220, such as a light emitting diode (LED) or other indicator that indicates when the short-range wireless transceiver is transmitting. Battery life indicator 222, includes a bar graph display implemented by individual LED's that indicate an estimated remaining battery life. In addition, remote control device 225 includes a system reset 226 button, all stop button and run automatic timed program button 230.

The operation of remote control device 226 can be described in terms of the following examples of operation. In particular, consider a case where the portable traffic signaling system includes two portable traffic signals 100 and 102 that are programmed to run an automatic timed program for an east-west street that is confined to one way flow due to construction.

Step 1: Traffic flow east
Unit 100 green light, unit 102 red light, (60 seconds)
Step 2: Clear east traffic flow
Unit 100 yellow light, unit 102 red light (5 seconds)
Unit 100 red light, unit 102 red light, (20 seconds)
Step 3: Traffic flow west
Unit 100 red light, unit 102 green light, (60 seconds)
Step 4: Clear west traffic flow
Unit 100 red light, unit 102 yellow light (5 seconds)
Unit 100 red light, unit 102 red light, (20 seconds)
Step 5: Return to Step 1

In response to a user pressing the run automatic timed program button 230, the remote control device sends control data to portable traffic signals 100 and 102 via the short range wireless communications link to begin the timed program. In the event that the user of remote control device needs to stop all traffic flow in both directions due to, for example, an alarm condition from one of the portable traffic signals 100 or 102, a car violating a red light, the need for a construction vehicle to pass, or other condition, the user can press the all stop button 228. In response, the remote control device 225 sends control data to portable traffic signals 100 and 102 via the short range wireless communications link that either causes the unit 100 and 102 traffic lights to immediately go to red or to cycle to red while first presenting a yellow light for a predetermined period. In a further mode of operation, the user can press the system reset button 226 to send control data to portable traffic signals 100 and 102 via the short range wireless communications link to cause the portable traffic signals to enter into a reset state, such as a blinking red light, red light, blinking yellow light or other reset state.

It should be noted that other configurations of remote control device 225 are likewise possible in accordance with other embodiments. For example, the remote control device can further include a manual advance button that advances the automated program from its current step to the next step. In this fashion, a timed step can be shortened manually by the user in response to actual traffic conditions, for example if there is light traffic flow in one direction. In another example, the remote control device can further include a pause button, that holds the automated program on its current step. In this fashion, for example, a timed step can be lengthened manually by the user in response to actual traffic conditions, for example if there is heavy traffic flow in one direction.

Figure 6:
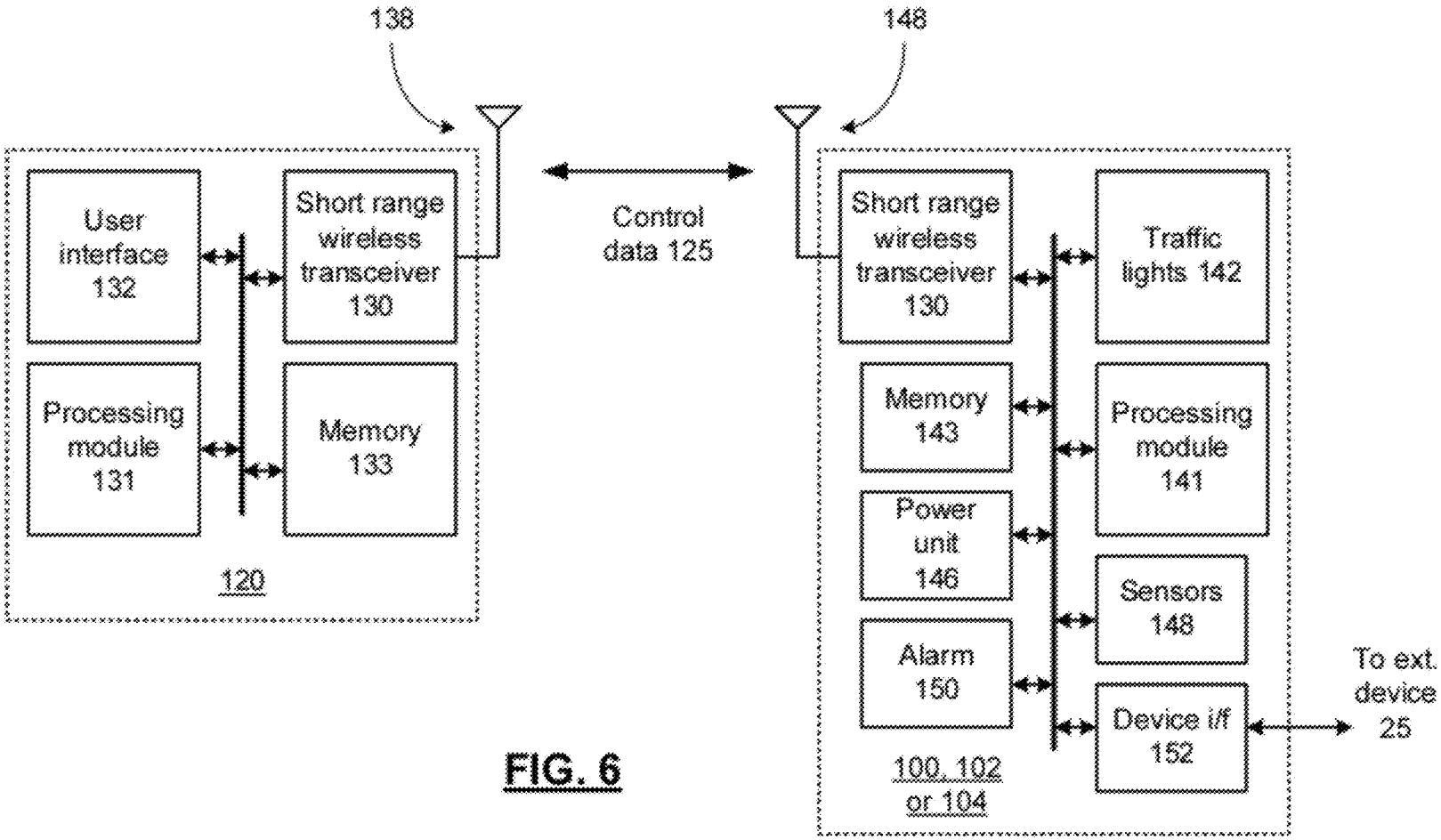
FIG. 6 presents a block diagram representation of remote control device 120 and portable traffic signal 100, 102 or 104 in accordance with an embodiment of the present invention.

FIG. 6 presents a block diagram representation of remote control device 120 and portable traffic signal 100, 102 or 104 in accordance with an embodiment of the present invention. In particular, remote control 120 includes a short range wireless transceiver 130, processing module 131, user interface 132 and memory 133. Portable traffic signal 100, 102 or 104 includes a short range wireless transceiver 130, processing module 141, traffic signals 142, memory 143, power unit 146, sensors 148, alarm 150 and device interface (I/F) 152.

The short-range wireless transceivers 130 provide bidirectionally communication of control data 125 via either a wireless infrared or RF signaling over one or more short-range wireless communication channels. The short-range wireless transceiver operates via antenna 148 to transmit and receive signals in accordance with a communication standard such as 802.11, Bluetooth, ZigBee, ultra-wideband, Wimax, infrared data association (IrDA), other standard short or medium range communication protocol, or other protocol. Control data 125 sent from the remote control device 120 and the portable traffic signals 100, 102 and 104 can be used to coordinate the control of the traffic lights 142 of the portable traffic signals 100, 102 and 104.

The processing module 131 can be implemented using a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on operational instructions that are stored in memory, such as memory 133. Note that when the processing module 131 implements one or more of its functions via a state machine, analog circuitry, digital circuitry, and/or logic circuitry, the memory storing the corresponding operational instructions may be embedded within, or external to, the circuitry comprising the state machine, analog circuitry, digital circuitry, and/or logic circuitry. Further note that, the memory module 133 stores, and the processing module 131 executes, operational instructions corresponding to at least some of the steps and/or functions illustrated herein.

The memory module 133 may be a single memory device or a plurality of memory devices. Such a memory device may be a read-only memory, random access memory, volatile memory, non-volatile memory, static memory, dynamic memory, flash memory, cache memory, and/or any device that stores digital information. While the components of remote control device 120 are shown as being coupled by a particular bus structure, other architectures are likewise possible that include additional data busses and/or direct connectivity between components. Remote control device 120 can include additional components that are not expressly shown.

Likewise, the processing module 141 can be implemented using a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on operational instructions that are stored in memory, such as memory 143. Note that when the processing module 141 implements one or more of its functions via a state machine, analog circuitry, digital circuitry, and/or logic circuitry, the memory storing the corresponding operational instructions may be embedded within, or external to, the circuitry comprising the state machine, analog circuitry, digital circuitry, and/or logic circuitry. Further note that, the memory module 143 stores, and the processing module 141 executes, operational instructions corresponding to at least some of the steps and/or functions illustrated herein.

The memory module 143 may be a single memory device or a plurality of memory devices. Such a memory device may be a read-only memory, random access memory, volatile memory, non-volatile memory, static memory, dynamic memory, flash memory, cache memory, and/or any device that stores digital information. While the components of portable traffic signal 100, 102 or 104 are shown as being coupled by a particular bus structure, other architectures are likewise possible that include additional data busses and/or direct connectivity between components. Portable traffic signal 100, 102 or 104 can include additional components that are not expressly shown.

User interfaces 132 and 142 each can contain one or more push buttons, a sound emitter, light emitter, a touch screen or other display screen, a thumb wheel, trackball, and/or other user interface devices. The traffic lights 142 can include traditional traffic lights implemented one or more light emitting elements that operate via incandescent, fluorescent or halogen technologies, via LEDs or via other light emitting devices, together with one or more drivers or relays used to selectable switch on and off each of the traffic lights 142.

Device interface 152 provides an interface between the portable traffic signal 100, 102 or 104 and an external device 25, such as a computer or other host device, peripheral or charging unit. The device interface 152 can include one or more jacks or other connectors for coupling to a standalone charger or other source of power, and/or that provide a standard interface such as universal serial bus (USB), Firewire, or other standard or non-standard interface.

The power unit 146 can include a non-rechargeable battery or battery pack or a rechargeable battery pack that can be charged via an integral solar cell, via the device interface 152 when connected to a direct current (DC) power source, an alternating current (AC) power source, via connection to a PC or other charging device or the battery pack can be removable for charging on a standalone basis. The alarm 150 includes an audible alarm such as a buzzer, beeper, siren or other alarm device and/or a strobe, flashing light, or other visual alarm device.

Sensors 148 include one or more traffic sensors, such as a metal detector, proximity detector, electric eye, or video imaging system that generates sensor data that indicates either the presence of one or more cars in queue waiting to pass and/or that generates passage data that indicates passage of a vehicle past the portable traffic signal 100, 102 and 104, for example to allow the processing module 141 to count the number of vehicles that have passed during a particular cycle and to detect that a vehicle has passed through a red light, etc.

In operation, the processing module 131 executes instructions from memory 133 to generate control data 125 that is transmitted to a plurality of portable traffic signal 100, 102 and 104 via the short range wireless communication link. Processing module 141 executes instructions from memory 143 to controls the operation of the traffic lights 142 to stop and go conditions, reset conditions, right and left turn conditions, a yellow light caution condition, yield conditions and or other states or conditions, based on control data 125, based on sensor data and passage data from sensors 148 and optionally based on other control data received from other portable traffic signal 100, 102 and 104 via the short range wireless communication link.

Figure 7:
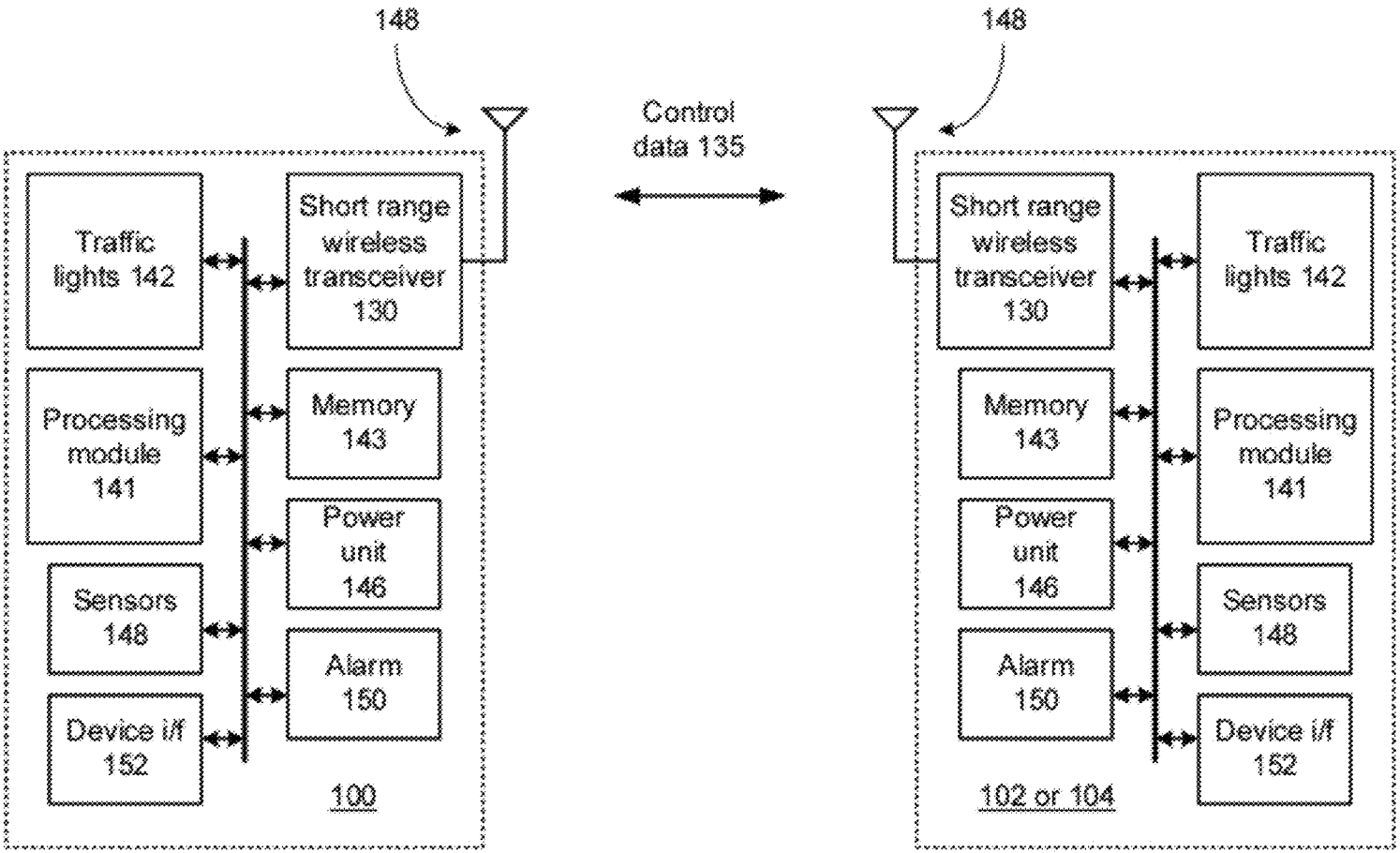
FIG. 7 presents a block diagram representation of portable traffic signal 100 and portable traffic signal 102 or 104 in accordance with an embodiment of the present invention.

FIG. 7 presents a block diagram representation of portable traffic signal 100 and portable traffic signal 102 or 104 in accordance with an embodiment of the present invention. In this embodiment, one or both of the processing modules 141 executes instructions from memory 143 to control the operation of the traffic lights 142 to stop and go conditions, reset conditions, right and left turn conditions, a yellow light caution condition, yield conditions and or other states or conditions, based on control data 125, based on sensor data and passage data from sensors 148 and optionally based, but further based on other control data 135 received from the other portable traffic signal 100, 102 or 104 via the short range wireless communication link.

In operation, a portable traffic signal 100 can operate as a master unit to generate control data 135 via its corresponding traffic signal processing module 141 and sends the control data to portable traffic signal 102 or 104 via the short range wireless communication link. One or more portable traffic signals 102 or 104 operates as a slave unit to generate control data to control operation of their corresponding traffic lights 142 based the control data 135 received from the master unit.

In operation, code that controls the automated timed program described above is loaded in memory 143 of portable traffic signal 100 and executed as program steps by processing module 141 of this device. As such processing module 141 includes either a hardware timer or executes one or more software timers to implement the timing functions of the automated timed program. Portable traffic signal 100, via its processing module 141, and further in response to control data 125 received from remote control device 120 or 225 generates internal control data to control the operation of its own traffic lights 142. In addition, the portable traffic signal 100, via its processing module 141, generates control data 135 to control the operation of the traffic lights 142 of portable traffic signal 102 or 104. In particular, the bidirectional communication that includes control data 135 further includes handshake signal or other acknowledgement returned from portable traffic signal 102 or 104 to portable traffic signal 100 via the short range wireless communication link. This acknowledgement structure allows the master unit to know that the slave unit has received the control data 135 and the automated timed program can proceed.

Considering again the example presented in conjunction with FIG. 5 where the portable traffic signaling system includes two portable traffic signals 100 and 102 that are programmed to run an automatic timed program for an east-west street that is confined to one way flow due to construction.

Step 1: Traffic flow east
Unit 100 green light, unit 102 red light, (60 seconds)
Step 2: Clear east traffic flow
Unit 100 yellow light, unit 102 red light (5 seconds)
Unit 100 red light, unit 102 red light, (20 seconds)
Step 3: Traffic flow west
Unit 100 red light, unit 102 green light, (60 seconds)
Step 4: Clear west traffic flow
Unit 100 red light, unit 102 yellow light (5 seconds)
Unit 100 red light, unit 102 red light, (20 seconds)
Step 5: Return to Step 1

In Step 1, the master unit 100 sends control data 135 to slave unit 102 to produce a red light. When the acknowledgement is received, the master unit 100 controls its traffic lights to green and begins timing. In Step 3, the master unit 100 controls its traffic lights to red and sends control data 135 to slave unit 102 to produce a green light. When the acknowledgement is received, and master unit 100 begins timing. In Step 4, the sends control data 135 to slave unit 102 to produce a yellow light and then a red light, either as a single transaction or as two separate transactions. When the red light signal is acknowledged, the master unit 100 proceeds to Step 5 and on to Step 1.

In an embodiment of the present invention, alarm data generated by the processing module 141 of a particular portable traffic signal 100, 102 or 104 that is used to activate its own alarm 150 can further be used to generate control data 135 that is sent via the short range wireless communication link to all other portable traffic signals 100, 102 or 104. The control data 135, once received, can be processed by the processing modules of the other portable traffic signals 100 to activate their alarms 150 as well.

As previously discussed, sensor data from sensors 148 can generate information that is useful to the conduct of a traffic control. An automatic timed program executed by the master unit can be based on not only sensor data generated by the master unit but also based on sensor data generated by sensors 148 from one or more slave units and sent to the master unit via the short range wireless communication link as control data 135.

Consider a different example where the portable traffic signaling system includes two portable traffic signals 100 and 102 that are programmed to run an automatic timed program for an east-west street that is confined to one way flow due to construction. Step 1 of the previous example can be modified to take into consideration the sensor data, from units 100 and 102. In particular, when portable traffic signal 100 is the master unit, its own sensor data as well as sensor data received from unit 102 as control data 135 can be used to modify the conditions to change from Step 1 to Step 2.

Step 1: Traffic flow east
Unit 100 green light, unit 102 red light,
Proceed to next step when either:
- 60 seconds passes and, at the end of 60 seconds there is a car waiting in queue at unit 102); or
- 20 cars pass unit 100; or
- 120 seconds passes and there were no cars waiting in queue of unit 102 after 60 seconds It should be noted that the transition from Step 3 to Step 4 could also be conditioned on a similar, though reciprocal set of circumstances.

Figure 8:
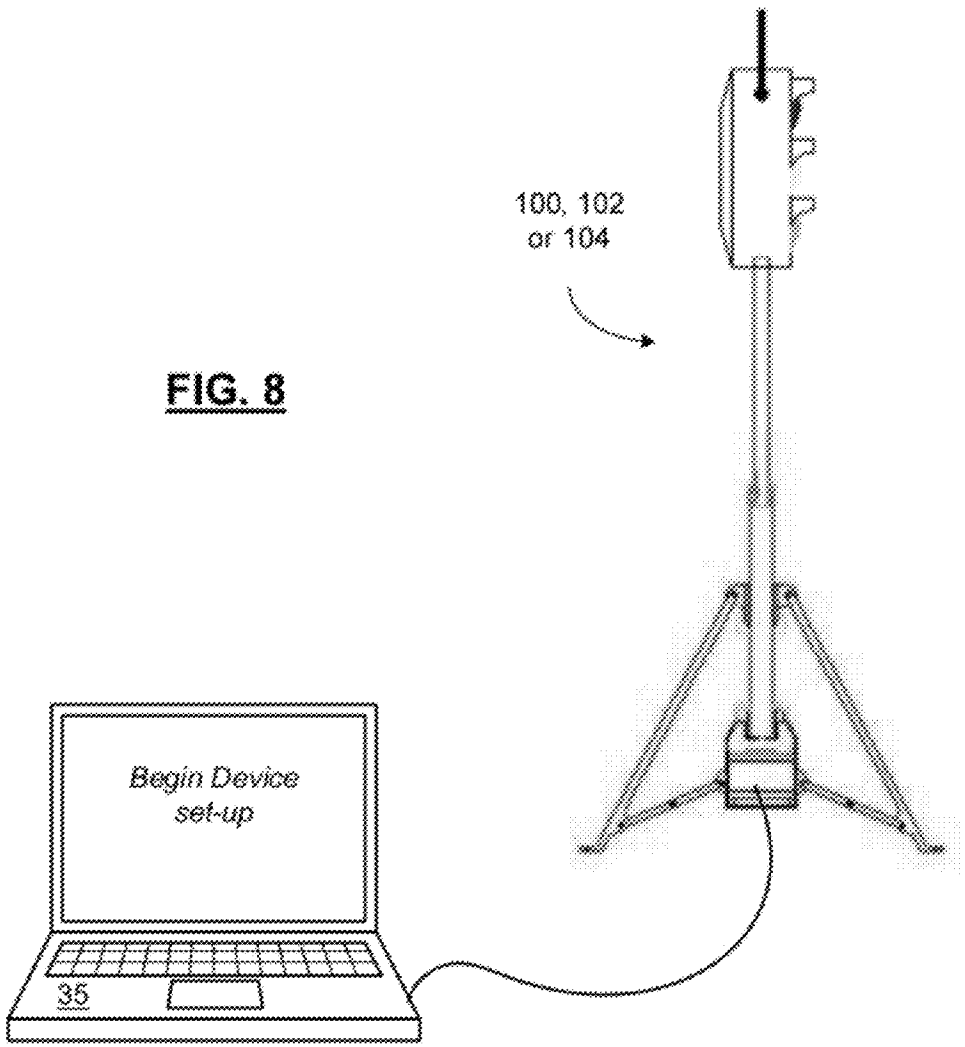
FIG. 8 presents a pictorial representation of a computer 25 and portable traffic signal 100, 102 or 104 in accordance with an embodiment of the present invention.

FIG. 8 presents a pictorial representation of a computer 35 and portable traffic signal 100, 102 or 104 in accordance with an embodiment of the present invention. In particular, computer 35 is an example of external device 25 that is coupled to a portable traffic signal 100, 102 or 104 via a USB connection of device interface 152. In particular, computer 35 includes an application run by its operating system that creates the automated timed program and downloads the parameters, code or other data to each of the portable traffic signals 100, 102 or 104 (both the master unit and the in slave unit or units) in order to implement the automated timed program.

In particular, the user of computer 35 is able to set up the number and types of portable traffic signals 100, 102 and 104, the steps in the automatic timed program, the types of sensor data used and the conditions for proceeding from step to step including the times for each of the timed steps and conditions, the functionality of the remote control device 120 or 225, and other parameters of the portable traffic signaling system.

Figure 9:
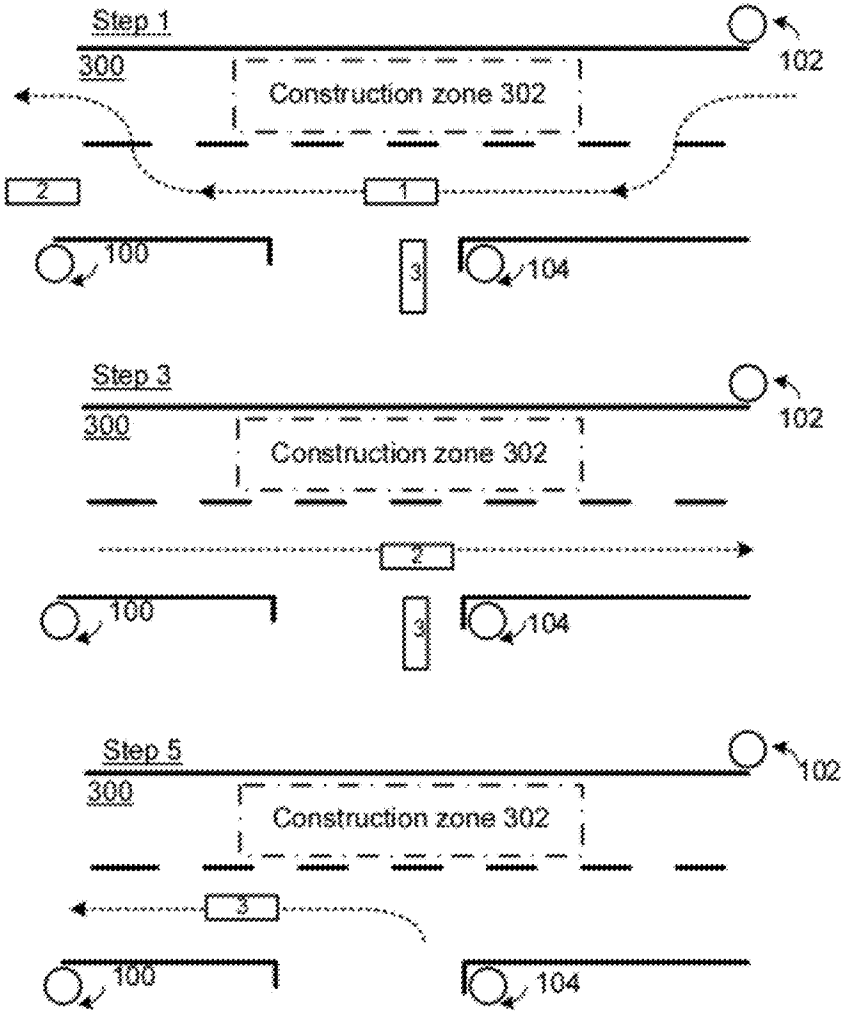
FIG. 9 presents a schematic diagram of a construction scene in accordance with an embodiment of the present invention.

FIG. 9 presents a schematic diagram of a construction scene in accordance with an embodiment of the present invention. In particular, a construction scene 300 is shown having construction zone 302. The traffic in the area is being controlled by a portable traffic signaling system that includes portable traffic signals 100, 102 and 104, where unit 100 is the master unit and units 102 and 104 are slave units. The timed automatic program includes step 1, step 3 and step 5 that occur at different times and allow car 1, car 2 and car 3 to pass through the area safely, while traffic from other directions is stopped.

While the description above has set forth several different modes of operation, the devices described here may simultaneously be in two or more of these modes, unless, by their nature, these modes necessarily cannot be implemented simultaneously. While the foregoing description includes the description of many different embodiments and implementations, the functions and features of these implementations and embodiments can be combined in additional embodiments of the present invention not expressly disclosed by any single implementation or embodiment, yet nevertheless understood by one skilled in the art when presented this disclosure.

As one of ordinary skill in the art will appreciate, the term "substantially" or "approximately", as may be used herein, provides an industry-accepted tolerance to its corresponding term and/or relativity between items. Such an industry-accepted tolerance ranges from less than one percent to twenty percent and corresponds to, but is not limited to, component values, integrated circuit process variations, temperature variations, rise and fall times, and/or thermal noise. Such relativity between items ranges from a difference of a few percent to magnitude differences. As one of ordinary skill in the art will further appreciate, the term "coupled", as may be used herein, includes direct coupling and indirect coupling via another component, element, circuit, or module where, for indirect coupling, the intervening component, element, circuit, or module does not modify the information of a signal but may adjust its current level, voltage level, and/or power level. As one of ordinary skill in the art will also appreciate, inferred coupling (i.e., where one element is coupled to another element by inference) includes direct and indirect coupling between two elements in the same manner as "coupled". As one of ordinary skill in the art will further appreciate, the term "compares favorably", as may be used herein, indicates that a comparison between two or more elements, items, signals, etc., provides a desired relationship.

For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

In preferred embodiments, the various circuit components are implemented using 0.35 micron or smaller CMOS technology and can include one or more system on a chip integrated circuits that implement any combination of the devices, modules, submodules and other functional components presented herein. Provided however that other circuit technologies including other transistor, diode and resistive logic, both integrated or non-integrated, may be used within the broad scope of the present invention. Likewise, various embodiments described herein can also be implemented as software programs running on a computer processor. It should also be noted that the software implementations of the present invention can be stored on a tangible storage medium such as a magnetic or optical disk, read-only memory or random access memory and also be produced as an article of manufacture.

Thus, there has been described herein an apparatus and method, as well as several embodiments including a preferred embodiment. Various embodiments of the present invention herein-described have features that distinguish the present invention from the prior art.

It will be apparent to those skilled in the art that the disclosed invention may be modified in numerous ways and may assume many embodiments other than the preferred forms specifically set out and described above. Accordingly, it is intended by the appended claims to cover all modifications of the invention which fall within the true spirit and scope of the invention.

What is claimed is:

1. A portable traffic signaling system comprising:

a plurality of portable traffic signals, each of the portable traffic signals including:

a plurality of traffic lights;

a stand, coupled to the plurality of traffic lights, the stand having legs that fold for transport and unfold for deployment;

a short range wireless traffic signal transceiver that communicates bidirectionally via a short range wireless communication link;

a traffic signal memory;

a traffic signal processing module, coupled to the plurality of traffic lights, the short range wireless transceiver, and the memory, that controls the operation of the plurality of traffic lights, based on first control data, to at least: a stop condition, and a go condition; and at least one traffic sensor that generates passage data that indicates passage of a vehicle past a corresponding one of the plurality of portable traffic signals and wherein the corresponding one of the plurality of traffic signals includes an audible alarm device that is activated via alarm data and wherein the corresponding traffic signal processing module generates the alarm data to activate the audible alarm device when the passage data indicates the passage of the vehicle past the corresponding one of the plurality of portable traffic signals concurrently when the corresponding one of the plurality of portable traffic signals is in the stop condition; and a remote control device that includes:

a remote control memory;

a remote control processing module, coupled to the memory, that generates second control data; and a short range wireless remote control transceiver, coupled to the processing module, that transmits the second control data to the plurality of portable traffic signals via the short range wireless communication link;

wherein the first control data is generated by each traffic signal processor, based on the second control data.

2. The portable traffic system of claim 1 wherein the plurality of portable traffic signals includes:

a slave portable traffic signal, wherein the first control data for the slave portable traffic signal is generated based on third control data; and a master portable traffic signal that generates third control data via its corresponding traffic signal processing module and sends the third control data to the slave portable traffic signal via the short range wireless communication link.

3. The portable traffic system of claim 1 wherein the plurality of portable traffic signals includes:

a side street traffic signal, wherein its corresponding plurality of traffic lights include at least one turn indicator.

4. The portable traffic system of claim 1 further comprising:

at least one traffic sensor that generates traffic sensor data;

wherein first control data for one of the plurality of portable traffic signals includes the traffic sensor data generated via its corresponding at least one traffic sensor.

5. The portable traffic system of claim 1 further comprising:

at least one traffic sensor that generates traffic sensor data;

wherein first control data for one of the plurality of traffic signals includes the traffic sensor data generated via another one of the plurality of portable traffic signals and received via the short range wireless communication link.

6. A portable traffic signaling system comprising:

a plurality of portable traffic signals, each of the portable traffic signals including:

a plurality of traffic lights;

a stand, coupled to the plurality of traffic lights, the stand having legs that fold for transport and unfold for deployment;

at least one traffic sensor that generates traffic sensor data wherein the at least traffic sensor includes a sensor generates passage data that indicates passage of a vehicle past a corresponding one of the plurality of portable traffic signals;

a short range wireless traffic signal transceiver that communicates bidirectionally via a short range wireless communication link;

a traffic signal memory; and a traffic signal processing module, coupled to the plurality of traffic lights, the at least one traffic sensor, the short range wireless transceiver, and the memory, that controls the operation of the plurality of traffic lights, based on first control data, to at least: a stop condition, and a go condition, and wherein the corresponding traffic signal processing module generates alarm data when the passage data indicates the passage of the vehicle past the corresponding one of the plurality of portable traffic signals concurrently when the corresponding one of the plurality of portable traffic signals is in the stop condition;

an audible alarm device that is activated via the alarm data; and a remote control device that includes:

a remote control memory;

a remote control processing module, coupled to the memory, that generates second control data; and a short range wireless remote control transceiver, coupled to the processing module, that transmits the second control data to the plurality of portable traffic signals via the short range wireless communication link;

wherein the first control data is generated by each traffic signal processor, based on the second control data.

7. The portable traffic system of claim 6 wherein the plurality of portable traffic signals includes:

a slave portable traffic signal, wherein the first control data for the slave portable traffic signal is generated based on third control data; and a master portable traffic signal that generates third control data via its corresponding traffic signal processing module and sends the third control data to the slave portable traffic signal via the short range wireless communication link.

8. The portable traffic system of claim 6 wherein the plurality of portable traffic signals includes:

a side street traffic signal, wherein its corresponding plurality of traffic lights include at least one turn indicator.

9. The portable traffic system of claim 6 wherein first control data for one of the plurality of portable traffic signals includes the traffic sensor data generated via its corresponding at least one traffic sensor.

10. The portable traffic system of claim 6 wherein first control data for one of the plurality of traffic signals includes the traffic sensor data generated via another one of the plurality of portable traffic signals and received via the short range wireless communication link.

* * * * *